US006307192B1

(12) United States Patent
Ulfstedt et al.

(10) Patent No.: US 6,307,192 B1
(45) Date of Patent: Oct. 23, 2001

(54) OVENABLE FOOD TRAY AND ITS MANUFACTURING METHOD

(75) Inventors: Jack Owe Lennart Ulfstedt, Turku; Liisa Marjatta Kukko, Parainen; Tapani Penttinen, Huutjärvi, all of (FI)

(73) Assignees: Stora Enso Oyj, Stora-Helsinki; Oy Zeus Ultrastructures AB, Oy-Parainen, both of (FI)

( * ) Notice: Subject to any disclaimer, the term of this patent is extended or adjusted under 35 U.S.C. 154(b) by 0 days.

(21) Appl. No.: 09/308,385

(22) PCT Filed: Nov. 17, 1997

(86) PCT No.: PCT/FI97/00701

§ 371 Date: Jul. 19, 1999

§ 102(e) Date: Jul. 19, 1999

(87) PCT Pub. No.: WO98/22654

PCT Pub. Date: May 28, 1998

(30) Foreign Application Priority Data

Nov. 22, 1996 (FI) ..... 964662

(51) Int. Cl.[7] ..... H05B 6/80

(52) U.S. Cl. ..... 219/725; 99/DIG. 14; 525/507

(58) Field of Search ..... 219/725, 730, 219/731; 426/203, 311, 423; 99/DIG. 14; 525/100, 527, 507; 156/306; 427/155; 524/730

(56) References Cited

U.S. PATENT DOCUMENTS 3,431,143 * 3/1969 Johnson et al. ..... 525/507
4,042,441 * 8/1977 Wasserman et al. ..... 156/306
4,181,687 * 1/1980 Ward et al. ..... 525/100
4,332,923 6/1982 Rainear ..... 525/507
5,700,516 * 12/1997 Sandvick et al. ..... 427/155
5,907,013 * 5/1999 Ogawa ..... 524/730

FOREIGN PATENT DOCUMENTS 0245005 11/1987 (EP) .
2160539 12/1985 (GB) .

* cited by examiner

*Primary Examiner*—Tu Ba Hoang
(74) *Attorney, Agent, or Firm*—Birch, Stewart, Kolasch & Birch, LLP

(57) ABSTRACT

The invention is related to an ovenable food tray (1) and its manufacturing method. The paperboard or cardboard tray is provided with at least one layer of polymeric coating (3, 4) which, according to the invention, is lying at least on the side of the tray coming into contact with the food and contains a polymerized crosslink structure which consists of an inorganic, chain or crosslinked polymeric backbone which contains alternating silicon and oxygen atoms and which comprises side chains and/or crosslinks formed by organic groups or chains. The tray (1) is manufactured by spreading, on the board (2), a mixture which contains reactive ingredients and which is polymerized to form a grease-tight, glassy coating (3, 4) that withstands heat, on at least one and preferably both sides of the paperboard, and by forming the tray from the thus obtained, coated paperboard. The polymerized ingredients can be organosilanes with which crosslinking organic compounds, such as epoxides, can be reacted. The coated tray thus obtained is water- and grease-tight and it withstands the operating temperatures of conventional ovens and microwave ovens.

18 Claims, 1 Drawing Sheet

OVENABLE FOOD TRAY AND ITS MANUFACTURING METHOD

This application is the national phase under 35 U.S.C. §371 of PCT International Application No. PCT/FI97/00701 which has an International filing date of Nov. 17, 1997 which designated the United States of America.

BACKGROUND OF THE INVENTION

1. Field of the Invention

The object of the invention is an ovenable food tray consisting of a board base of paperboard or cardboard provided with at least one heat resistant polymeric coating layer. Another object of the invention is a manufacturing method of such a food tray.

2. Description of Related Art

Ovenable food trays, such as microwave oven or conventional oven trays, are used as parts of consumer packages of foodstuffs, such as casserole foods intended to be heated, and they are also sold as separate products. Such underlayers must be impermeable to water and grease; and in addition to this, sufficient heat-resistance is required from ovenable trays. Up till now, polyester-coated paperboard has been used in ovenable trays. Its disadvantages include the thickness of the required polymeric layer and the fact that it is very difficult for the polymeric coating to withstand typical oven temperatures of more than 200° C. The microwave oven trays intended to be heated in microwave ovens have been provided with a polymeric coating of polypropylene but its heat-resistance is also limited.

In the EP application 0 245 005 there is described an ovenable food tray which consists of a laminate of paper and paperboard layers and has a coating of a food grade resin such as polyethylene terephtalate (PET) on its food contacting side and a nonburning coating of silicone polymer on the reverse side, covering the paper layer of the laminate. While the silicone coating possesses an increased resistance to heat the use of polyethylene terephtalate still limits the ability of the tray to withstand high oven temperatures.

SUMMARY OF THE INVENTION

The purpose of the invention is to provide a paperboard or cardboard food tray, such as a microwave oven or conventional oven tray, with improved properties, specifically improved heat-resistance together with reduced weight, as compared with known board trays.

The tray according to the invention is characterized in that the polymeric coating of the tray is lying at least on the side of the tray coming into contact with the food and contains a polymerized crosslink structure consisting of an inorganic, chained or crosslinked polymeric backbone which contains alternating silicon and oxygen atoms and which also comprises side chains and/or crosslinks formed by organic groups or chains.

In the food tray according to the invention the use of purely organic coatings has been avoided. There is instead a silicon-based coating layer with a superior heat resistance based on the partially inorganic nature of the coating material. The coating is lying at least on the food contact side of the tray and preferably on both sides of the tray.

The coated paperboard or cardboard used in the tray according to the invention can be manufactured, starting from silane, an organic compound reacting with is water, and a possible catalyst, whereby the silane is hydrolyzed and condensed, forming colloidal particles and reacts with the organic compound so that the silane produces a polymeric backbone mainly consisting of silicon and oxygen, and the organic compound works as a crosslinker. When organosilane containing reactive, organic groups is used, it may be unnecessary to use a separate organic compound. This results in a sol consisting of colloidal particles in which the reaction continues with the particles growing and being combined so that a chained or crosslinked gel is obtained, covering the surface of the board, the gel being finally cured by heating or irradiating it using UV, IR, laser or microwave radiation to form a thin, tight coating on the board. Depending on the circumstances, the drying/curing time may vary from fractions of a second to several hours. The coating thus obtained simultaneously features typical characteristics of both an inorganic and an organic substance, and the properties of the coating can be adjusted by selecting components that react in a proper way.

DETAILED DESCRIPTION OF THE INVENTION

The water- and grease-proof coating layer of the food tray according to the invention which is tough, withstands creasing, and does not break when bent, can be rendered very thin without creating small, visually unperceivable pin holes in the coating, during the forming stage or later when heated or jointed, which constitute a problem in known coating materials made of organic polymers and because of which the layers of coatings had to be made relatively thick. On the basis of preliminary tests, a tight layer of coating can be provided on a smooth paperboard base by as low amount of coating as 1 $g/m^2$, and, in practice, a preferred amount of coating is in the range of about 2 to 6 $g/m^2$. Therefore, the invention provides essential savings in material and a decrease in the weight of the board as compared with those known from before. Another advantage of the invention is that the spreading of the coating mixture is easy to accomplish using the methods generally used in paper and board industry, such as rod coating or blade coating techniques or by spraying. The spreading of the coating may thus be effected in the board machine by using the "on-line" principle as part of the manufacturing process of the board, by using the same types of spreading devices that are used for application of normal coating mixes. The coating can also be spread on premoulded tray blanks or in connection with the moulding of the tray. When needed, fillers can be added, the most preferable materials including scale- or slatelike mineral fillers, such as talc, mica or glass flakes which settle in the direction of the coating and contribute to its properties of impermeability. It is also possible to dye the coating by adding pigments or organic colouring agents to the mixture, or to add organic and/or inorganic fibres or particles to the formulation, the fastening of which to the coating can be improved by the use of coupling agents. Furthermore, it is possible to include, in the mixture, an organic, polymerizing agent which forms a separate polymeric structure with respect to the inorganic chain or crosslinked structure according to the invention and which intermeshes with it. In addition to the board machine, the spreading of the coating can be carried out, in connection with a printing process, for example, on a finished board base which does not necessarily have to be dried first. In this case, the board can be precoated with any kind of coating commonly used in paper and board industry.

The good heat-resistance of the coating is a special advantage of the food tray according to the invention. The board can be moulded into a tray by pressing at a high temperature and the trays easily withstand the normal temperatures of kitchen stoves and microwave ovens, and even temperatures exceeding 300° C. at which the board base will begin to char. At the same time, the layers of coating protect the board from the softening effect of steam coming from the food when heated so that the tray maintains its form. When baked, the food does not stick to the coating according to the invention. The tray provided in accordance with the invention can be part of the consumer package of prepared food, for example, whereby the food is intended to be heated in the tray after opening the package, or the trays can be sold to consumers as such.

The chain or crosslinked structure of the polymeric coating provided according to the invention can consist of silicon or metal atoms and oxygen atoms which alternate with them. The structure preferably consists of mainly silicon and oxygen, and small numbers of metal atoms may be combined with the same backbone as substitutes for silicon. The metals can preferably include Ti, Zr, and Al, for example. Organic groups combined with the polymeric structure can mainly include substituted or unsubstituted alkyl and aryl groups.

According to the invention, the polymerization reaction generating by the silicon-based polymeric backbone of the coating can be described by way of an example by the following formula:

$$u\,Me(OR)_4 + v\,(HX)_nSi(OR)_{4-n} + w\,(YX)_mSi(OR)_{4-m} \xrightarrow[\text{- HOR}]{\text{+ } H_2O} \text{(n = M = 2)}$$

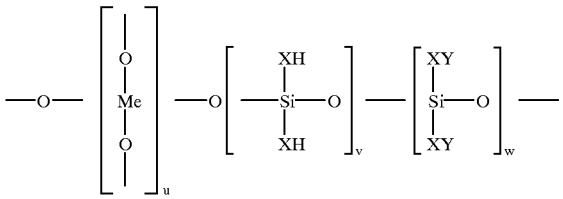

in which

Me refers to a tetravalent metal atom,

R refers to an alkyl group or hydrogen,

X refers to an alkyl or aryl body or chain, for example,

Y refers to a substituent which can be, for example, an amino, a hydroxyl, a carbonyl, a carboxyl, a vinyl, an epoxy, or a methacrylate group, u, v, and w are integer numbers, and n and m are integers in the range of 1 to 3.

The organic crosslinks of the polymer can be generated by the mutual reactions of reactive substituents Y.

According to the invention, a mixture can alternatively be polymerized, comprising, in addition to one or more components forming an inorganic polymeric backbone, at least one purely organic component (as opposed to silico-organic compounds such as e.g. organosilanes) which forms organic side chains and/or crosslinks. In this case, the generation of a crosslink can be described as an addition reaction by the following formula:

$$2[—(YX)_2SiO_2—] + Z_2X^1 \longrightarrow$$

-continued

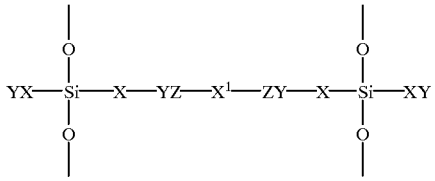

in which:

X and $X^1$, which can be mutually the same or different, refer to an alkyl or aryl backbone or chain, for example, and Y and Z, which can be mutually the same or different, refer to substituents reacting mutually, such as amino, hydroxyl, carbonyl, carboxyl, vinyl, epoxy or methacrylate groups. The reaction can be, for example, an addition or a condensation depending on the reacting groups.

One advantage of using the said purely organic component could be its lower price as compared with silane, and the better completion of the polymerizing reaction. The thus generated silicon-based polymeric backbone can in some cases constitute a steric hindrance to the mutual reactions of the reactive substituents of silane, while a free separate organic compound is able to continue, even after it, the reaction, forming side chains and/or crosslinks between the inorganic silicon-oxygen chains. The amount of the organic component can also be used to adjust the degree of organicity of the thus obtained coating and the properties connected with it.

The organic component included in the reaction mixture can be in monomeric form and, at the time of spreading the mixture, prepolymerized to a varying degree and/or combined with the silane. The organic component can also :be in the form of a pre-polymer when added to the reaction mixture. The amount of the organic component can be, calculated as a monomer, 5 to 80, preferably 10 to 70, and most preferably 10 to 50 molar percent of the total amount of the polymerizing starting materials of the reaction mixture.

The liquid medium needed in the process according to the invention can contain, for example, water, alcohol, and/or liquid silane. The hydrolyzation effected in the above exemplary reaction binds water, providing that water is present, while at the same time alcohol is released in the reaction, converting into a liquid phase.

Organosilanes containing hydrolyzing and condensing groups, or their hydrolyzates are suitable for starting materials of the process according to the invention.

Correspondingly, compounds can be used whose central atom is, for example, Zr, Ti, Al, B, etc., mixtures of these compounds or mixtures of the above-mentioned silicon and metal compounds.

Epoxy silanes of the following type can be used:

$$(YX)_a(HX^1)_bSi(OR)_{4-a-b} \quad (1)$$

in which:

Y=a reactive organic group, such as an epoxy group, a vinyl group or another polymerizing organic group, X and $X^1$=a hydrocarbon group containing 1 to 10 carbon atoms, R=a hydrocarbon group containing 1 to 7 carbon atoms, an alkoxyalkyl group or an acyl group containing 1 to 6 carbon atoms, a=number 1 to 3, b=number 0 to 2, provided that a +b≦3.

Examples of the silanes according to formula (1), containing epoxy groups, are listed in the following. Typical silicon compounds containing one glycidoxy group include, for example, glycidoxymethyltrimethoxysilane, glycidoxymethyltriethoxy-silane, β-glycidoxyethyltriethoxysilane, β-glycidoxyethyltrimethoxysilane, γ-glycidoxypropyltrimethoxysilane, γ-glycidoxypropyltriethoxysilane, γ-glycidoxypropyltri-(methoxyethoxy)silane, γ-glycidoxypropyltriacetoxysilane, δ-glycidoxybutyltri-methoxysilane, δ-glycidoxybutylthrietoxysilane, glycidoxymethyldimethoxysilane, glycidoxymethyl (methyl)dimethoxysilane, glycidoxymethyl(ethyl) dimethoxysilane, glycidoxymethyl(phenyl) dimethoxysilane, glycidoxymethyl(vinyl)dimethoxysilane, β-glycidoxyethyl(methyl)dimethoxysilane, β-glycidoxyethyl(ethyl)dimethoxysilane, γglycidoxypropyl (methyl)dimethoxysilane, γ-glycidoxypropyl(ethyl) dimethoxy-silane, δ-glycidoxybutyl(methyl) dimethoxysilane, and δ-glycidoxybutyl(ethyl)dimethoxysilane.

Typical silicon compounds that contain two glycidoxy groups include, for example, bis-(glycidoxymethyl) dimethoxysilane, bis-(glycidoxymethyl)diethoxysilane, bis-(glycidoxyethyl)dimethoxysilane, bis-(glycidoxyethyl) diethoxysilane, bis-(glycid-oxypropyl)dimethoxysilane, and bis-(glycidoxypropyl)diethoxysilane.

Examples of silicon compounds that are described by general formula (2)

$$(HX)_n Si(OR)_{4-n} \quad (2)$$

include dimethyldimethoxysilane, methyltrimethoxysilane, tetraethoxysilane, phenyl trimethoxysilane, and phenylmethyldimethoxysilane.

These compounds can be used as separate components or as mixtures of two or more compounds.

Other possible components include, for example, colloidal silica, i.e., a colloidal solution containing a certain fraction of very fine-grained silica anhydride powder and which is dispersed in water or alcohol, for example, and in which the particle diameter is preferably 1 to 100 nm.

The crosslinking organic compounds can include prepolymers with which the reactive groups of organosilanes preferably react so that similar reactive groups react mutually, forming crosslinks that combine inorganic oxygen silicon chains. For example, epoxide resin or aromatic diols can be used to react with silanes that contain epoxy groups.

Aromatic alcohols, such as Bisphenol A, Bisphenol S, and 1.5-dihydroxy naphthalene are suitable as diols. Acrylates can be used to react with silanes containing acrylic groups or acryloxy groups. Prepolymers which have reactive double bonds are used with vinyl silanes or other silanes containing polymerizable double bonds, as well as with silanes containing sulfhydryl groups. Polyols are used with silanes containing isocyanate groups. Isocyanates are used with silanes containing hydroxy groups and epoxide resin is used with aminosilanes.

Mineral fillers, such as for instance talc and mica can be used. Furthermore, coupling agents, tensides, and other additives which are used to prepare composites and coatings can be added to the mixture.

The hydrolyzates of the silicon compounds according to formulas (1) and (2) can be manufactured by hydrolyzing the corresponding compounds in a solvent mixture, such as a mixture of water and alcohol in the presence of acid, which method is commonly known. When the silicon compounds according to general formula (1) and (2) are used in the form of hydrolyzates, a better result is generally obtained by mixing the silanes and hydrolyzing the mixture.

A curing catalyst effects a rapid curing of the coating at a relatively low temperature and has an advantageous effect on the properties of the coating.

The following substances, for example, can be used as curing catalyst of silanes containing epoxy groups: Broensted acids, such as hydrochloric acid, nitric acid, phosphoric acid, sulphuric acid, sulphonic acid, etc.; Lewis acids, such as $ZnCl_3$, $FeCl_3$, $AlCl_3$, $TiCl_3$, and the metal salts of the corresponding organocomplex acids, such as sodium acetate, and zinc oxylate; organic esters of boric acid, such as methyl borate and ethyl borate; alkalis, such as sodium hydroxide and caustic potash; titanates, such as tetrabutoxy titanate and tetraisopropoxy titanate; metal acetyl acetonates, such as titanyl acetyl acetonate; and amines, such as n-butyl-amine, di-n-butylamine, guanidine, and imidazole.

Latent catalysts can also be used, such as salts of inorganic acids and carboxylic acids, such as ammonium perchlorate, ammonium chloride, and ammonium sulphate, ammonium nitrate, sodium acetate, and aliphatic fluorosulphonates.

The selection of the most suitable curing catalyst depends on the desired properties and the use of the coating composition.

Furthermore, the coating can contain solvents, such as alcohols, ketones, esters, ethers, cellosolves, carboxylates or their mixtures. Lower alcohols from methanol to butanol in particular are recommended. Methyl-, ethyl-, and butyl cellosolve, lower carboxylic acids and aromatic compounds, such as toluene and xylene, and esters, such as ethyl acetate and butyl acetate, are also commonly used. However, the use of solvents is preferably minimized, for example, by using silanes as solvents because the evaporation of solvent vapors in connection with the coating of the board causes extra arrangements.

To obtain a smooth coating, a small amount of a flow regulating agent (such as a block copolymer of alkylene dioxide and dimethylsiloxane) can be added if needed.

Antioxidants and substances which protect against UV-light can also be added to the coating.

Non-ionic tenside can be added to the coating solution to adjust its wetting properties and hydrophilic properties.

The silicon-based coating layer provided according to the above description has a glassy outward appearance and it is also tight and bendable, does not crack or form holes, is heat-resistant and chemically resistant. The coating is grease-tight, aroma-tight, and water vapor-tight, and it is not sensitive to moisture. In the recycling of material carried out by pulping, the minor amounts of coating material present do not harm the recycled pulp thus obtained.

The curing of the coating layer and removing the remaining liquid phase is preferably carried out by heating the coating to a temperature range of about 100 to 200° C. Heating removes the porosity from the coating, giving it the required grease-tightness.

As the thin, glassy coating layer provided according to the invention is transparent, the pictures and the text that have been printed on the board before the coating process will be visible. This is an advantage in food trays in which the glassy coating constitutes the outer surface of the product.

The board base as used in the present invention includes both the materials known as paperboard, with a weight up to 250 g/m$^2$, and those known as cardboard, with a weight of 250 g/m$^2$ or more. Paperboards with a weight in the range of 225–250 g/m$^2$ are preferred.

Furthermore, the invention comprises a method for manufacturing the ovenable food tray described above, which is characterized in that a polymeric coating layer is formed on a board base of paperboard or cardboard, said coating comprising a polymeric backbone which contains alternating silicon and oxygen atoms, and side chains and/or crosslinks formed by organic groups or chains, by spreading, on the board base, a mixture which contains reactive ingredients and which is polymerized to form a grease-tight, heating-resistant coating, and that the tray is formed of the coated paperboard thus obtained, so that the coating will be on the side of the tray coming into contact with food. The formation of the tray can be effected by die cutting, by creasing and bending or by pressing.

BRIEF DESCRIPTION OF THE DRAWINGS

In the appended drawings.

Figure 1:
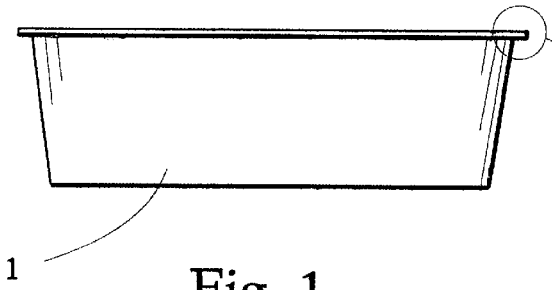
FIG. 1 shows the coated paperboard ovenable food tray according to the invention.
Figure 2:
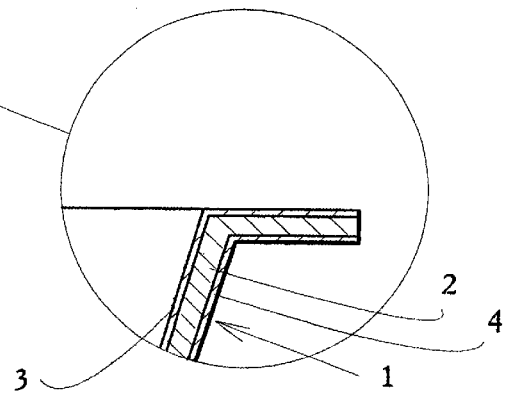
FIG. 2 shows a section of the tray edge as a partial enlargement of FIG. 1.

The ovenable tray 1 according to the invention which is showed in FIGS. 1 and 2 and which can be applied to a package of prepared food, for example, comprises paperboard layer 2 and glassy, silicon-based polymeric layers 3, 4 formed by a sol-gel process on the inner and outer surfaces of the tray. The weight of paperboard layer 2 is at least about 225 g/m$^2$ and the weight of both glassy polymeric layers 3, 4 is preferably about 2 to 5 g/m$^2$. Polymeric layers 3, 4 render the tray water- and grease-tight and they withstand the conventional kitchen stove operating temperatures of 200 to 250° C. without being damaged. The polymeric layer of the inner surface of the tray specifically prevents the food from sticking and the polymeric layer of the outer surface of the tray mainly protects the tray against the grease on the bake sheet and against the splatters coming from the food when heated. In some instances, the polymeric layer of the tray outer surface can be omitted. The illustrated tray I as such can also be used in microwave ovens.

The invention and the polymeric coating materials it employs are described by the following application examples.

EXAMPLE 1

Barrier coating 182 g of 2.2-bis(4-hydroxyphenyl)propane (component B) is dissolved by mixing in 473 g of gamma-glycidyloxypropyltrimethoxysilane (component A) at room temperature. 24 g of 0.1N hydrochloric acid is gradually added to this mixture, agitating it at the same time. Agitation is continued for about two hours, during which time 20 g of colloidal silica (Aerosil, Degussa) is added. When needed, 1 g of a flow regulating agent is added. The solution thus prepared is usable for at least one month. 16 g of methylimidazole (a Lewis acid) is added by mixing for about one hour before the solution is used. This solution is usable for about 24 hours.

The coating is effected by using the rod coating method on the following paperboards:

1. Pigment coated SBS paperboard Basis weight 235 g/m$^2$ Thickness 314 $\mu$m
2. Styrene butadiene dispersion coated paperboard
3. Cup board with smooth surface Basis weight 230 g/m$^2$ Thickness~300 $\mu$m The coating was heat-cured in a furnace at 160° C. for 2 minutes.

Test results

The coating solution according to Example 1 was used in the tests conducted on paperboard grades 1, 2, and 3. The results indicate that the coating solution with this viscosity suited smooth and less porous paperboard grades the best (samples 1 and 2).

When assessed visually, the coating is clear, transparent, and it has a good film forming ability. On the basis of an electron microscope study, the coating in samples 1 and 2 is whole and continuous. The coating in sample 3 is partly absorbed by the pores, causing holes.

The physical properties of the coating are shown in Table 1.

TABLE 1

The test results of Example 1

| Paperboard grade | Thickness of coating $\mu$m | Penetration of water vapor g/m$^2$/24 h, 23° C., 50% RH | Penetration of oxygen cm$^3$/m$^2$/24 h, 23° C. | Resistance to oil and grease, KIT-TEST | Resistance to temperature, DSC 25–300° C. |
|---|---|---|---|---|---|
| 1. Pigment SBS | 5 | 9 | 23 | 12 | No changes |
| 2. Dispersion coating | 4 | 3 | 30 | 12 | No changes |
| 3. Smooth cup board | 6 | 25 | 420 | 8 | No changes |

EXAMPLE 2

The solution is prehydrolyzed as in Example 1

Instead of colloidal silica, small amounts of fine-grained talc, totalling 180 g, are added by agitating continuously, 98% of the grain size of the talc being less than 10 $\mu$m (Finntalc C10).

After methyl imidazole had been added to the mixture, its viscosity was adjusted to suit the rod coating by adding about 7 g of colloidal silica to it.

The coating solution was used to coat the paperboard grades 1 and 3 according to Example 1. The coating was dried and cured in the same conditions as in Example 1.

Test results

When assessed visually, the coating is slightly matte and it has a good film forming ability.

The physical properties of the coating are presented in Table 2.

TABLE 2

The test results of Example 2

| Paperboard grade | Thickness of coating $\mu$m | Penetration of water vapor g/m$^2$/24 h | Penetration of oxygen cm$^3$/m$^2$/24 h | Resistance to oil and grease KIT-TEST | Resistance to temperature DSC 25–300° C. |
|---|---|---|---|---|---|
| 1. Pigment SBS | 10 | 11 | 33 | 12 | No changes |
| 3. Smooth cup board | 12 | 9.8 | 29 | 12 | No changes |

EXAMPLE 3

Preparation 236 g of gamma-glycidyloxypropyltrimethoxysilane (1 mol) is prehydrolyzed by gradually adding 27 g of the water solution of hydrochloric acid 0.1N at room temperature, agitating the mixture at the same time. Agitation is continued for two hours. The solution is usable in this form for at least one month.

8.2 g of N-methylimidazole (a Lewis acid) is added by agitating for about one hour before the solution is used. The solution is usable in this form for about 24 hours, with the viscosity gradually increasing. A talc suspension was prepared by mixing, with 100 ml of ethanol, 81.4 g of talc with a grain size of less than 10 $\mu$m. The talc was added in small amounts. A flow regulating agent and the talc ethanol suspension are added to the coating solution by agitating just before the solution is used for coating.

The coating solution was used to coat the paperboard grades 1 and 3 by using a rod coater.

The coating was first dried at 80° C. for 10 minutes and hardened at 160° C. for 6 minutes.

Test results

When examined visually, the coating is slightly matte and forms an integral film on the paperboard.

TABLE 3

The test results of Example 3

| Paperboard grade | Thickness of coating $\mu$m | Penetration of water vapor g/m$^2$/24 h | Resistance to oil and grease KIT-TEST | Resistance to temperature DSC 25–300° C. |
|---|---|---|---|---|
| 1. Pigment SBS | 9 | 8 | 12 | No changes |
| 3 Smooth cup board | 12 | 7 | 12 | No changes |

When bent, the 12 $\mu$m coating does not break at the bending radius of 1 mm.

EXAMPLE 4

Preparation 37 g of vinyltrimethoxysilane $CH_2{=}CH{-}Si(OCH_3)_3$, 49 g of mercaptopropyltri-methoxysilane $HSCH_2CH_2CH_2Si(OCH_3)_3$, 250 g of ethyl acetate, and 27 g of 0.1N HCl were mixed at 25° C. for two hours.

The mixture of ethylacetate and the formed methanol is removed from the solution by vacuum distillation at 30° C. The solution thus obtained is immediately used for coating as such. The coating was spread by using the rod coating method and the coating was cured using UV light of 1200 W for 12 seconds.

The coating solution was used to coat the paperboard grades 1 and 3.

Test results

When assessed visually, the coating is clear, transparent, and it forms a continuous, glassy surface.

TABLE 4

The test results of Example 4

| Paperboard grade | Thickness of coating $\mu$m | Penetration of water vapor g/m$^2$/24 h | Penetration of oxygen cm$^3$/m$^2$/24 h | Resistance to oil and grease KIT-TEST | Resistance to temperature DSC 25–300° C. |
|---|---|---|---|---|---|
| 1. Pigment SBS | 5 | 22 | 27 | 12 | No changes |
| 3. Smooth cup board | 11 | 12 | 32 | 12 | No changes |

EXAMPLE 5

35.6 g of phenyltrimethoxysilane, 276.6 g of glycidyloxypropyltrimethoxysilane, and 19.8 g of aminopropyltriethoxysilane were mixed in a vessel in an ice bath. 6 g of water was gradually added to this mixture by dropping and agitation in the ice bath was continued for 15 minutes, whereupon 12 g of water was added in small amounts and the mixture was further agitated in the ice bath for 15 minutes. Then 97.2 g of water was added by dropping it faster and agitation was continued for two hours at room temperature. Then 43.6 g of epoxy resin (Dow Corning D.E.R. 330) was added to this hydrolyzate. Coating was carried out on paperboards 1 to 3 according to Example 1 by using the rod coating method. The coating was cured in a furnace at 160° C.

TABLE 5

The test results of Example 5

| Paperboard grade | Thickness of coating $\mu$m | Penetration of water vapor g/m$^2$/24 h 23° C., 50% RH | Penetration of oxygen cm$^3$/m$^2$/24 h 23° C. | Resistance to oil and grease KIT-TEST | Resistance to temperature DSC 25–300° C. |
|---|---|---|---|---|---|
| 1. Pigment SBS | 4 | 10 | 25 | 12 | No changes |
| 2. Dispersion coated | 4 | 4 | 32 | 12 | No changes |
| 3. Smooth cup board | 6 | 12 | 35 | 12 | No changes |

EXAMPLE 6

The solution was prehydrolyzed as in Example 5.147 g of mica (Kemira Mica 40) was added to the hydrolyzate. The coating solution was used to coat the paperboard grades 1, 2, and 3 according to Example 5. The coating was cured and dried as in Example 5.

Test results

When examined visually, the coating is slightly matte and it has a good film forming ability. The physical properties of the coating are presented in Table 6.

TABLE 6

The test results of Example 6

| Paperboard grade | Thickness of coating μm | Penetration of water vapor g/m²/24 h, 23° C., 50% RH | Penetration of oxygen cm³/m²/24 h 23° C. | Resistance to oil and grease KIT-TEST | Resistance to temperature DSC 25–300° C. |
|---|---|---|---|---|---|
| 1. Pigment SBS | 5 | 8 | 20 | 12 | No changes |
| 2. Dispersion coated | 6 | 4 | 25 | 12 | No changes |
| 3. Smooth cup board | 6 | 10 | 30 | 12 | No changes |

It is clear to those skilled in the art that the different embodiments of the invention are not limited to the examples described above but can vawy within the appended claims.

What is claimed is:

1. An ovenable food tray which comprises a board base of paperboard or cardboard provided with at least one layer of heat resistant polymeric coating wherein the coating is lying on the side of the tray coming into contact with the food and comprises a polymerized crosslink structure containing an inorganic crosslinked polymeric backbone with alternating silicon and oxygen atoms and side chains or crosslinks formed by organic groups or chains.

2. A food tray according to claim 1, comprising a board base, both sides of which are provided with a water- and grease-tight polymeric coating that withstands a temperature of 200 to 250° C.

3. A food tray according to claim 1, wherein the weight of the coating layer is at least 1 g/m².

4. A food tray according to claim 1, wherein the board base is constituted by paperboard having a weight in the range of 225–250 g/m².

5. A method for manufacturing a food tray (1) according to claim 1, wherein said layer of polymeric coating (3,4) is formed on said board base of paperboard or cardboard (2), said coating is formed by spreading on the board base, wherein said inorganic cross-linked polymeric backbone with alternating silicon and oxygen atoms is formed by a mixture containing reactive ingredients which is polymerized to form a water- and grease-tight coating so that the coating will be on the side of the tray coming into contact with food.

6. The method according to claim 5, wherein the board base is provided, on both sides, with said water- and grease-tight polymeric coating that withstands a temperature of 200 to 250° C.

7. The method according to claim 5 wherein the steps of forming a polymerizing reaction mixture containing silane, water, a solvent, and, if desired, a reactive organic component, spreading the mixture on said board base, allowing the mixture to gel, and curing the mixture to form a tight layer of coating on said board base.

8. The method according to claim 7, wherein the mixture that is spread on the board base is a colloidal mixture comprising a liquid phase with polymerizing ingredients and colloidal reactive particles.

9. The method according to claim 7, wherein filler, is also brought on the board base to constitute part of the thus created coating layer.

10. The method according to claim 7, wherein the curing is carried out by heat at a curing temperature of about 100 to 200° C.

11. The method according to claim 7, wherein the curing is carried out by irradiation.

12. The method according to claim 5, wherein in the mixture that is spread on the board base, at least one organosilane is included which contributes to forming a silicon-based polymeric backbone and which contains a reactive epoxy, amino, hydroxyl, carboxyl, carbonyl, vinyl or methacrylate group that forms crosslinks.

13. The method according to claim 5, wherein at least one silane that contributes to forming a silicon-based polymeric backbone and at least one reactive, organic component that forms side chains or crosslinks are included in the mixture that is spread on the board base.

14. The method according to claim 13, wherein the said organic component contains at least one reactive epoxy, amino, hydroxyl, carboxyl, carbonyl, vinyl or methacrylate group.

15. The method according to claim 5, wherein the board base is printed, whereupon a transparent layer of polymeric coating is formed on the printed surface.

16. A food tray according to claim 3, wherein the weight of the coating layer is about 2 to 6 g/m².

17. The method according to claim 9, wherein the filler is either talc or mica.

18. The method according to claim 7, wherein the solvent is alcohol.

* * * * *